US007391377B2

(12) United States Patent
Matsushita et al.

(10) Patent No.: US 7,391,377 B2
(45) Date of Patent: Jun. 24, 2008

(54) POLARIZATION SWITCHING/VARIABLE DIRECTIVITY ANTENNA

(75) Inventors: Akio Matsushita, Osaka (JP); Tomoyasu Fujishima, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/938,497

(22) Filed: Nov. 12, 2007

(65) Prior Publication Data

US 2008/0062063 A1 Mar. 13, 2008

Related U.S. Application Data

(63) Continuation of application No. PCT/JP2007/054517, filed on Mar. 8, 2007.

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/702, 846, 756, 770
See application file for complete search history.

(56) References Cited

U.S. PATENT DOCUMENTS

| | | | | |
|---|---|---|---|---|
| 7,129,897 | B2 * | 10/2006 | Iigusa et al. | 343/700 MS |
| 7,312,757 | B2 * | 12/2007 | Watanabe | 343/702 |
| 2003/0062963 | A1 | 4/2003 | Aikawa et al. | |

FOREIGN PATENT DOCUMENTS

| | | |
|---|---|---|
| JP | 1-191282 | 8/1989 |
| JP | 9-167214 | 6/1997 |
| JP | 9-307350 | 11/1997 |
| JP | 2000-223927 | 8/2000 |
| JP | 2003-110322 | 4/2003 |

(Continued)

OTHER PUBLICATIONS

Fujishima, T., et al., "Reconfigurable Antennas by Controlling the Topology of Circuits on a Ground Plane", Advance Technology Research Laboratories, 2004, B-1-140.

(Continued)

*Primary Examiner*—Hoang V Nguyen
(74) *Attorney, Agent, or Firm*—McDermott Will & Emery LLP

(57) ABSTRACT

A polarization switching/variable directivity antenna according to the present invention includes a radiation conductor plate 12 on a front face, and a ground conductor plate 14 on a rear face, of a dielectric substrate 11. At least one directivity switching element and at least two polarization switching elements are provided within the ground conductor plate 14 on the rear face. The directivity switching element includes a first slot which is formed by a removing a loop-like portion from the ground conductor plate 14 and at least two directivity switching switches (22*a* to 22*d*). Each polarization switching element includes a first slot which is formed by removing a loop-like portion from the ground conductor plate 14 and at least one polarization switching switch (23*a* to 23*d*). Switching of a maximum gain direction of radiation directivity of the antenna is realized through control of the directivity switching switches 22*a* to 22*d*, and switching of the rotation direction of a circularly polarized wave which is emitted from the antenna is realized through control of the polarization switching switches 23*a* to 23*d*.

3 Claims, 16 Drawing Sheets

FOREIGN PATENT DOCUMENTS

| | | | |
|---|---|---|---|
| JP | 2004-304226 | | 10/2004 |
| JP | 2005-159401 | | 6/2005 |
| JP | 2006-005679 | | 1/2006 |
| WO | WO 2005-062421 | A1 | 7/2005 |
| WO | WO 2006/004156 | A1 | 1/2006 |

OTHER PUBLICATIONS

Ramash Garg et al., "Circularly Polarized Microstrip Antennas and Techniques", Microstrip Antenna Design Handbook, pp. 493-515, no date avail.

* cited by examiner

*FIG.4*
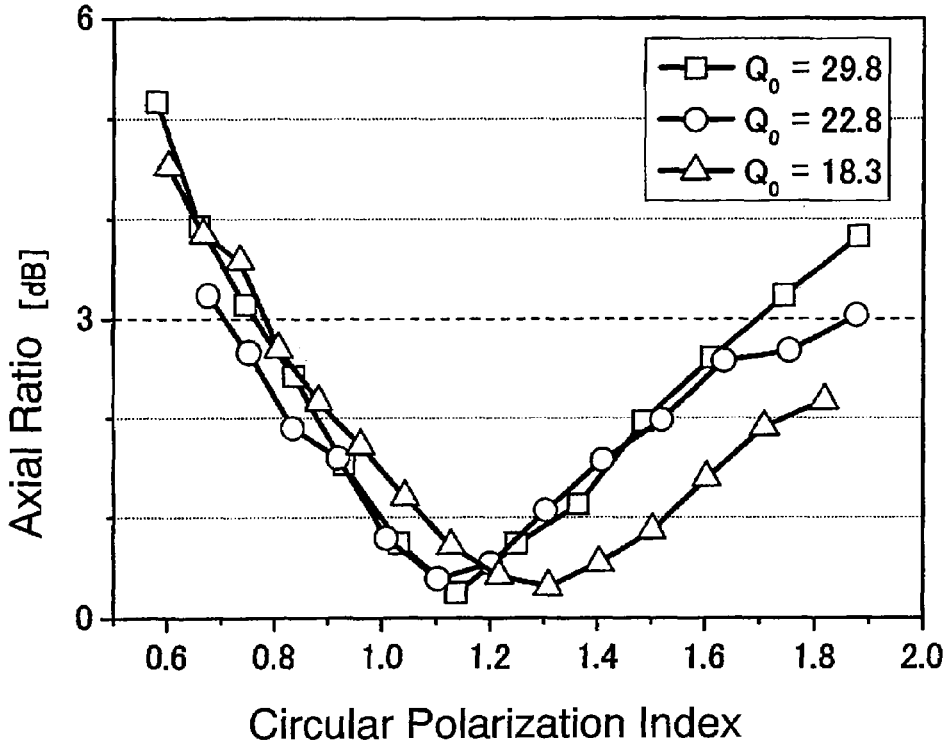
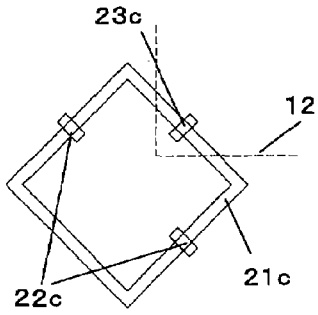
*FIG.5A*
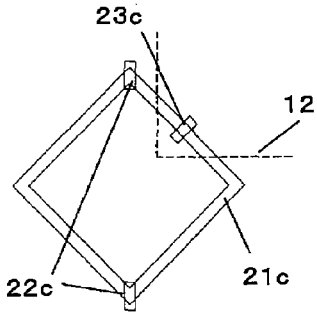
*FIG.5B*
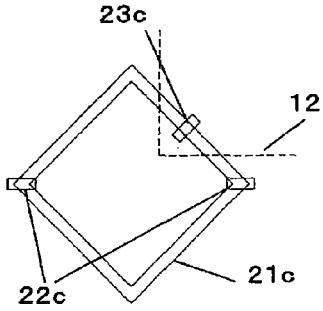
*FIG.5C*

FIG.8A
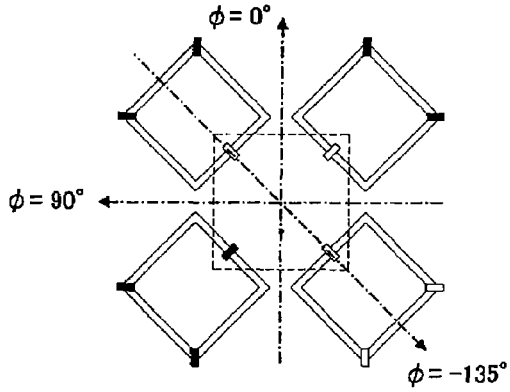
FIG.8B
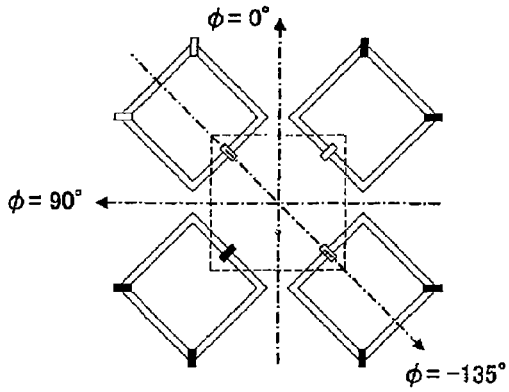
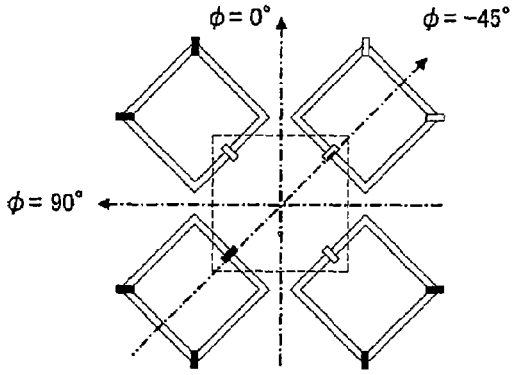
FIG.8C
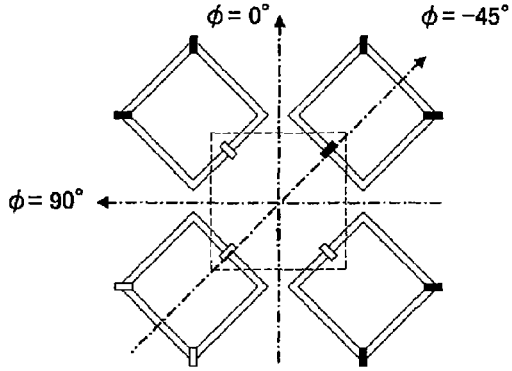
FIG.8D

Linearly Polarized Wave

Counterclockwise Circularly Polarized Wave

Clockwise Circularly Polarized Wave

POLARIZATION SWITCHING/VARIABLE DIRECTIVITY ANTENNA

This is a continuation of International Application No. PCT/JP2007/054517 with an international filing date of Mar. 8, 2007, which claims priority of Japanese Patent Application No. 2006-111756, filed on Apr. 14, 2006, the contents of which are hereby incorporated by reference.

BACKGROUND OF THE INVENTION

1. Field of the Invention

The present invention relates to an antenna which is suitable for high-quality wireless communications in the microwave and extremely high frequency ranges, where communications are performed while switching the rotation direction of a circularly polarized wave and a maximum gain direction of radiation directivity.

2. Description of the Related Art

In recent years, there are increasing needs for rapid large-capacity communications in a closed space, e.g., an indoor space, as exemplified by indoor wireless LAN, for example. In a closed space such as an indoor space, there are not only direct waves along a line-of-sight between antennas, but also delayed waves due to reflections from the walls, ceiling, or the like exist, thus constituting an environment of multipath propagation. This multipath propagation is a cause for deterioration of the communication quality.

In order to suppress deteriorations in communication quality that are caused by delayed waves in a multipath propagation environment, one method employs an antenna which permits switching of a maximum gain direction of radiation directivity. This is a method that enhances the communication quality by switching the maximum gain direction of the antenna and performing transmission/reception in a selected optimum state.

There is also a method which employs a circular polarization antenna in order to suppress deteriorations in communication quality caused by delayed waves in a multipath propagation environment. A circularly polarized wave is an electromagnetic wave which advances while the direction of its electric field vector rotates with time. When the direction of advancement is viewed from a fixed place, a circularly polarized wave whose electric field vector rotates clockwise is referred to as a clockwise circularly polarized wave, whereas a circularly polarized wave whose electric field vector rotates counterclockwise is referred to as a counterclockwise circularly polarized wave.

Usually, it is difficult to generate a completely circularly polarized wave, because it will merge with a polarization component of the opposite rotation, thus resulting in an elliptically polarized wave. The ratio between the major axis and the minor axis of this ellipse is referred to as an axial ratio, which serves as an index representing the characteristics of the circularly polarized wave. The smaller the axial ratio is, the better the circular polarization characteristics are. In a usual circular polarization antenna, the value of the axial ratio is 3 dB or less.

An antenna which is designed to transmit or receive clockwise circularly polarized waves cannot transmit or receive counterclockwise circularly polarized waves. Similarly, an antenna which is designed to transmit or receive counterclockwise circularly polarized waves cannot transmit or receive clockwise circularly polarized waves. Generally speaking, a circularly polarized wave which has impinged on an obstacle such as a wall becomes a circularly polarized wave of the opposite rotation, and is reflected therefrom. In other words, through one reflection, a clockwise circularly polarized wave becomes a counterclockwise circularly polarized wave, and through another reflection, again becomes a clockwise circularly polarized wave. Therefore, by using a circularly polarized wave for indoor communications, multipath components ascribable to a single reflection can be suppressed.

As a planar antenna which is capable of transmitting and receiving circularly polarized waves, a planar antenna that is described in Ramash Garg et al., "Microstrip Antenna Design Handbook", Artech House, p. 493-515 (hereinafter "Non-Patent Document 1") is well known, for example. FIG. 17A is a schematic illustration showing a generic linear polarization antenna, and FIGS. 17B and 17C are schematic illustrations showing the generic circular polarization antenna structures described in Non-Patent Document 1. In order to generate a circularly polarized wave, it is necessary to employ two linear polarization components which have orthogonal planes of polarization and whose phases are shifted by 90°. In a commonly-employed radiation conductor plate 31 as shown in FIG. 17A, which is shaped so as to be axisymmetrical with respect to a line extending through a center of gravity 32 of the radiation conductor plate and a feed point, resonation occurs only in such a manner that the electric current oscillates in the direction of the aforementioned line, whereby a linearly polarized wave having a plane of polarization in this oscillation direction results.

In order to generate a circularly polarized wave from the aforementioned axisymmetrically-shaped radiation conductor plate 31, the aforementioned resonation must be separated into two orthogonal resonations. In order to separate the aforementioned resonation, the structural symmetry of the radiation conductor plate 31 may be broken as shown in FIGS. 17B and 17C, for example. At this time, depending on where the symmetry is broken, a counterclockwise circularly polarized wave may be excited as shown in FIG. 17B, or a clockwise circularly polarized wave may be excited as shown in FIG. 17C.

However, as an antenna to be internalized in a laptop computer or an antenna for a mobile device, circular polarization antennas such as those shown in FIGS. 17B and 17C are unsuitable. The position and orientation of such a mobile terminal may greatly change, so that a circular polarization antenna having a fixed rotation direction may not be able to perform transmission/reception when it is reversed in orientation, for example. Therefore, as an antenna for realizing high-quality and high-efficiency communications in a mobile terminal device, there is needed an antenna that permits control of the rotation direction of a circularly polarized wave.

Moreover, communications with an even higher quality and higher efficiency can be realized by simultaneously realizing the aforementioned two functions that are effective for elimination of multipaths, i.e., a "function of switching the maximum gain direction of radiation directivity" and a "function of switching the rotation direction of a circularly polarized wave".

One conventional antenna that simultaneously realizes the aforementioned two functions, i.e., "switching of the rotation direction of a circularly polarized wave" and "switching of a maximum gain direction of radiation directivity" is a phased array antenna whose array elements are antennas capable of switching circular polarization (see Japanese Laid-Open Patent Publication No. 2000-223927). FIG. 18A is a block diagram showing the construction of one unit of a conventional circular polarization switching type-phased array antenna described in Japanese Laid-Open Patent Publication No. 2000-223927, supra. FIG. 18B is a block diagram showing the overall construction of a circular polarization switching type-phased array antenna.

As shown in FIG. 18A, in each antenna unit of a conventional circular polarization switching type-phased array antenna, switching of the rotation direction of a circularly polarized wave is realized through control of external signals s41 and s42, and switching of the radiation phase of the antenna is realized through control of external signals s43, s44 and s45. By building a multi-element construction composed of such units, as shown in FIG. 18B, and controlling all external signals by using an external controller, switching of the rotation direction of a circularly polarized wave and a maximum gain direction of radiation directivity of the entire phased array antenna is simultaneously realized.

However, an antenna having the above-described conventional construction is unsuitable as an antenna for a small-sized device or terminal because of problems such as: a plurality of phase shifters being required, thus resulting in complicated construction and control, and switching of a plurality of feed lines being required, thus resulting in a large insertion loss associated with switching elements.

The present invention solves the aforementioned conventional problems, and an objective thereof is to provide an antenna having a construction in which no phase shifter is used and there is only a single feed line so that there is no need for switching, thus simultaneously realizing switching of a maximum gain direction of radiation directivity of the antenna and switching of the rotation direction of a circularly polarized wave, with good characteristics such that an axial ratio in the maximum gain direction is 3 dB or less.

SUMMARY OF THE INVENTION

In order to solve the aforementioned problems, the present invention provides a polarization switching/variable directivity antenna comprising: a dielectric substrate 11 having two opposing surfaces; a radiation conductor plate 12 formed on one of the surfaces of the dielectric substrate; a feed point 13 provided on the radiation conductor plate; a ground conductor plate 14 formed on the other surface of the dielectric substrate; at least one directivity switching element 15 provided on the ground conductor plate side of the dielectric substrate; and at least two polarization switching elements 16 provided on the ground conductor plate side of the dielectric substrate.

The radiation conductor plate is shaped so as to be axisymmetrical with respect to a line extending through a center of gravity of the radiation conductor plate and through the feed point 13, the feed point being a point where feeding means is in contact with the radiation conductor plate. The at least one directivity switching element 15 includes a first slot 20*a* which is formed by removing a loop-like portion from the ground conductor plate 14, and at least two directivity switching switches 17 which are connected so as to bridge between an internal conductor 19 surrounded by the first slot 20*a* and the ground conductor plate 14 surrounding the first slot 20*a*.

The first slot 20*a* resonates at a frequency which is substantially equal to a resonant frequency of the radiation conductor plate 12. The peripheral length of the first slot 20*a* corresponds to one effective wavelength at an operating frequency. The directivity switching switches 17 are positioned so that, when the first slot 20*a* is split into a plurality of slots in high-frequency terms by allowing all of the at least two directivity switching switches 17 to conduct, the length of each slot having been split at both ends which are the at least two directivity switching switches 17 is less than half the effective wavelength, or is greater than half the effective wavelength and yet less than one effective wavelength.

The at least two polarization switching elements 16 each include a second slot 20*b*,20*c* which is formed by removing a loop-like portion from the ground conductor plate 14, and at least one polarization switching switch 18 which is connected so as to bridge between an internal conductor 19 surrounded by the second slot 20*b*,20*c* and the ground conductor plate 14 surrounding the second slot 20*b*,20*c*.

A portion of the second slot 20*b*,20*c* is in a position overlapping the radiation conductor plate 12. The circular polarization index Q0(Δs/s) has a value of no less than 0.8 and no more than 1.6, where Δ s is an area of an overlap between the radiation conductor plate 12 and a region surrounded by each second slot 20*b*,20*c*; s is an area of the radiation conductor plate 12; and Q0 is an unloaded Q of the radiation conductor plate 12.

With respect to an angle ξ between a line extending through the center of gravity 24 of the radiation conductor plate 12 and through the feed point 13 and a line extending through the center of gravity 24 of the radiation conductor plate and through a center of gravity 25 of the second slot, one second slot 20*b* of the at least two polarization switching elements is provided so as to satisfy either a range of 0°<ξ<90° or a range of 180°<ξ<270°, and another second slot 20*c* of the at least two polarization switching elements is provided so as to satisfy either a range of 90°<ξ<180° or a range of 270°<ξ360°.

By adopting such a construction, switching of a maximum gain direction, and switching of the rotation direction of a circularly polarized wave at the maximum gain direction can be simultaneously realized.

Further preferably, the circular polarization index is no less than 1.1 and no more than 1.3. Under this condition, further better circularly polarized wave characteristics can be obtained.

Each second slot 20*b*,20*c* comprised by the at least two polarization switching elements may also be a first slot 20*a* comprised by the at least one directivity switching element, such that both of the at least one polarization switching switch 18 and the at least two directivity switching switches 17 are provided on the second slot 20*b*,20*c*, whereby each polarization switching element 16 serves both a polarization switching function and a directivity switching function. With this construction, an element which doubles as a directivity switching element and a polarization switching element can be realized, thus enabling a more efficient switching of the maximum gain direction into multiple directions.

A polarization switching/variable directivity antenna of the present invention simultaneously realizes, in a simple construction which uses no phase shifters, and in a construction which employs a single feed line and in which an insertion loss of any switching element that might otherwise be necessary for switching a plurality of feed lines is avoided, switching of a maximum gain direction of radiation directivity and switching of the rotation direction of a circularly polarized wave which has good axial ratio characteristics along the maximum gain direction.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 1A is a see-through view of a first substrate surface; FIG. 1B is a see-through view of a second substrate surface; and FIG. 1C is a cross-sectional view of the substrate taken along A1-A2.

FIG. 4 is a graph showing a relationship between a circular polarization index and an axial ratio of a polarization switching/variable directivity antenna according to Embodiment 1 of the present invention.

FIGS. 5A to 5C are diagrams showing exemplary unpreferable placements of directivity switching switches of a polarization switching/variable directivity antenna according to Embodiment 1 of the present invention.

FIGS. 8A to 8D are diagrams showing examples of how switches of a polarization switching/variable directivity antenna according to Example 1 of the present invention may be controlled.

DETAILED DESCRIPTION OF PREFERRED EMBODIMENTS

Hereinafter, embodiments of the present invention will be described with reference to the accompanying drawings.

Embodiment 1

Figure 1B:
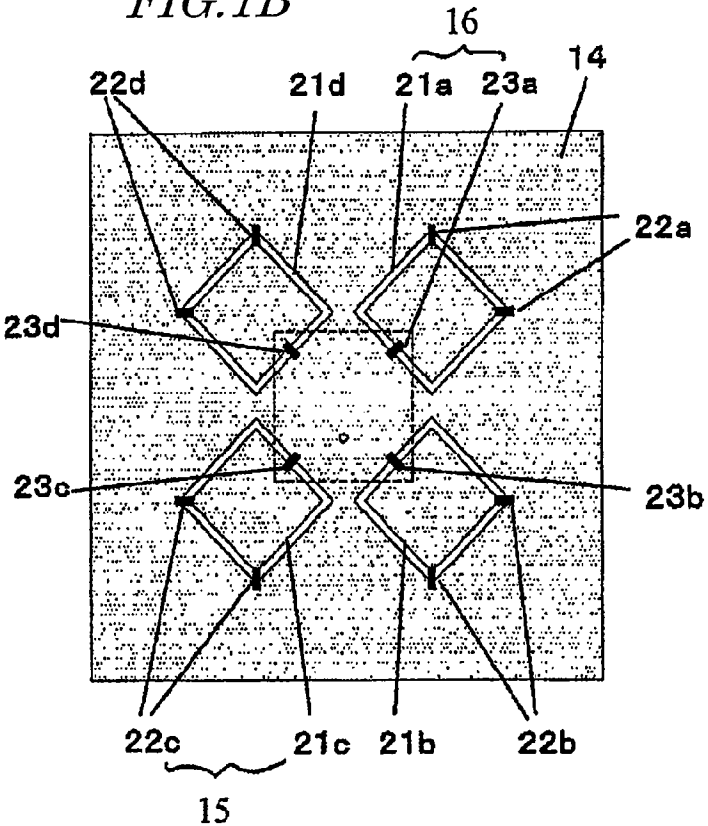
FIGS. 1A to 1C are schematic illustrations of a polarization switching/variable directivity antenna according to Embodiment 1 of the present invention.
Figure 1A:
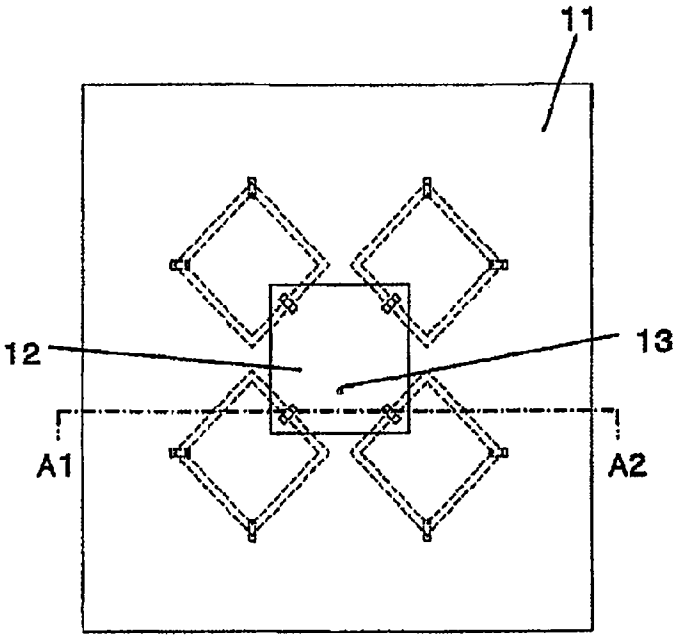
Figure 1C:
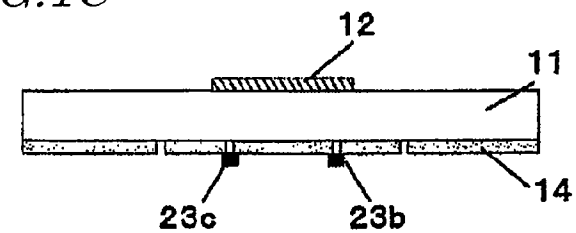

First, FIGS. 1A to 1C, which illustrate Embodiment 1 of the present invention, will be referred to. FIG. 1A is a see-through view of a first surface of a dielectric substrate 11. FIG. 1(*b*) is a see-through view of a second surface of the dielectric substrate 11 which opposes the first surface. FIG. 1(*c*) is a cross-sectional view taken along line A1-A2 in FIG. 1A.

According to Embodiment 1, each polarization switching element 16 serves both a polarization switching function and a directivity switching function. In other words, each polarization switching element 16 doubles also as a directivity switching element 15.

As shown in FIG. 1, the antenna of the present embodiment includes a radiation conductor plate 12 on the first surface of the dielectric substrate 11, and a ground conductor plate 14 on the opposing second surface. Slots 21*a* to 21*d* are provided in the ground conductor plate 14 on the second surface. Each of the slots 21*a* to 21*d* has at least two directivity switching switches (22*a* to 22*d*) and at least one polarization switching switch (23*a* to 23*d*) provided thereon. Switching of the maximum gain direction is realized through control of the directivity switching switches 22*a* to 22*d*, and switching of the rotation direction of a circularly polarized wave is realized through control of the polarization switching switches 23*a* to 23*d*.

The construction according to the present embodiment is a simple construction which employs no phase shifters, and can be operated with a single feed line. Therefore, any insertion loss associated with switching elements, which might otherwise be required for switching a plurality of feed lines, can be avoided.

Figure 2:
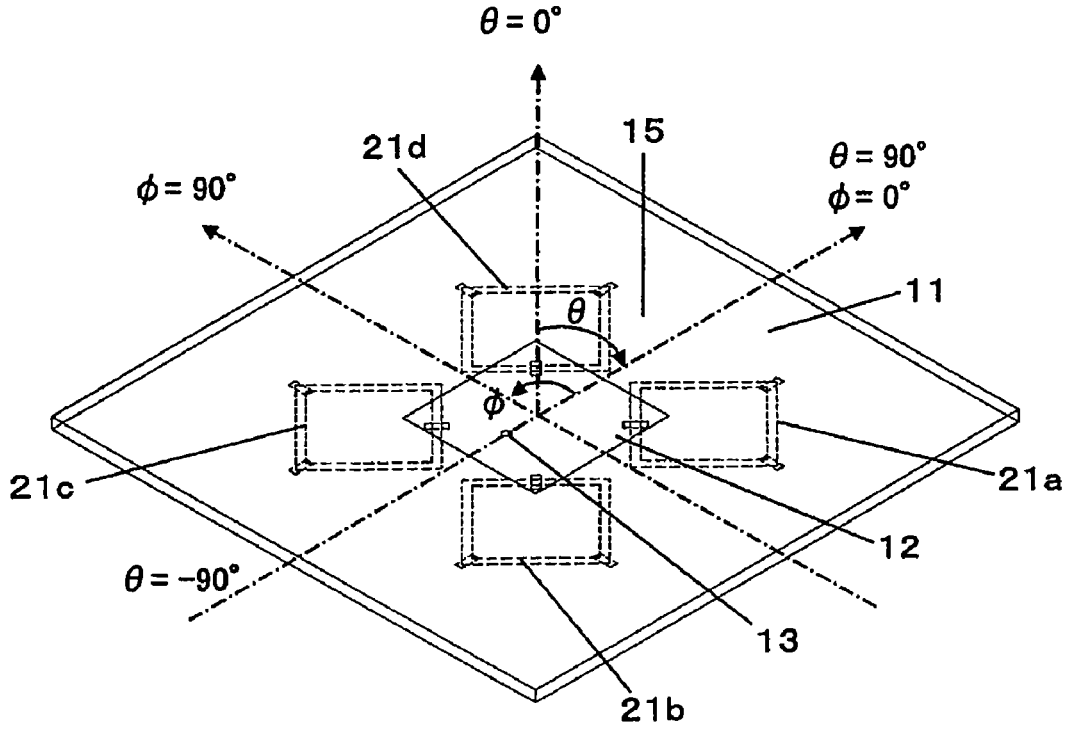
FIG. 2 is a perspective view of a polarization switching/variable directivity antenna according to Embodiment 1 of the present invention.

FIG. 2 shows a perspective view of the first substrate surface of the antenna according to Embodiment 1 of the present invention. In the antenna of Embodiment 1, a $\phi$ axis and a $\theta$ axis are defined as shown in FIG. 2. Hereinafter, in the present specification, radiation directivity will be illustrated according to this coordinate system.

Now, the principles behind switching of circular polarization and switching of the maximum gain direction of radiation directivity according to the polarization switching/variable directivity antenna of Embodiment 1 will be specifically described.

(Circular Polarization Switching)

First, the principle behind switching of circular polarization will be described. Switching of circular polarization is performed with polarization switching elements. Now, the polarization switching elements will be described. At least two polarization switching elements are provided within the ground conductor plate 14, each being composed of a loop-shaped slot (21*a* to 21*d*) and at least one polarization switching switch (23*a* to 23*d*). In Embodiment 1, the slots 21*a* to 21*d* are placed in positions overlapping the radiation conductor plate 12, and, by controlling the polarization switching switches 23*a* to 23*d* to enable or disable conduction, symmetry of the radiation conductor plate 12 is broken, whereby resonation is separated.

Figure 3:
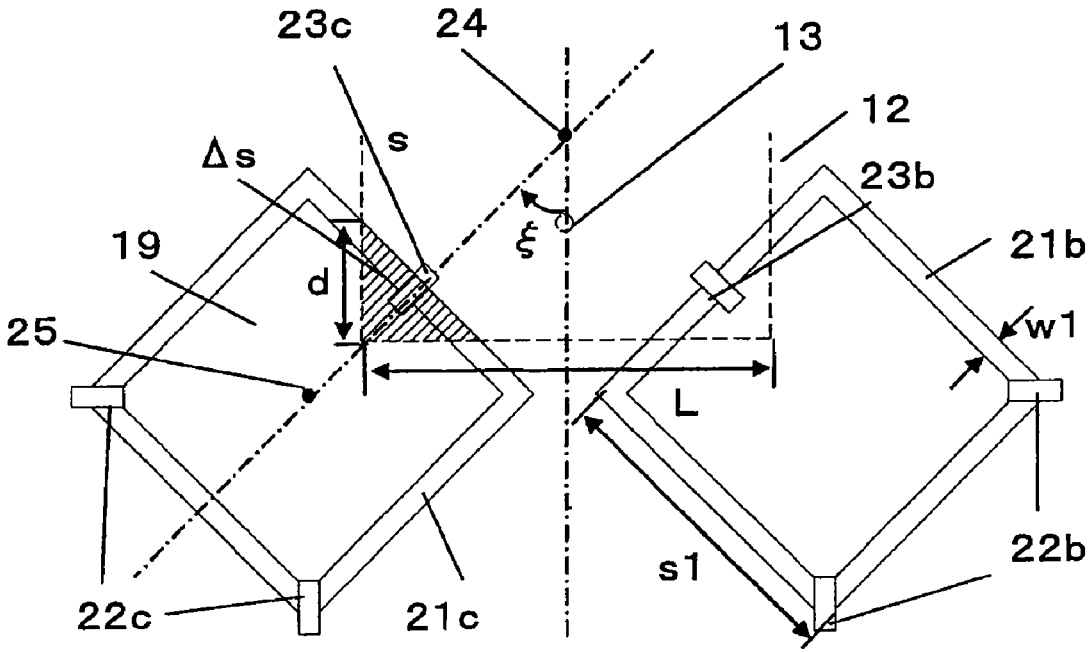
FIG. 3 is an enlarged view of a slot section of a polarization switching/variable directivity antenna according to Embodiment 1 of the present invention.

FIG. 3 shows an enlarged view of a slot section according to Embodiment 1 of the present invention. Slots 21*a* to 21*d* are formed by removing loop-like portions from the ground conductor plate 14. An angle ξ is defined between a line which extends through a center of gravity 24 of the radiation conductor plate 12 and a through feed point 13 and a line which extends through the center of gravity 24 of the radiation conductor plate and through a center of gravity 25 of each slot. At least one of the slots 21*a* to 21*d* is provided so as to satisfy either a range of 0°<ξ<90° or a range of 180°<ξ<270°, and at least another is provided so as to satisfy either a range of 90°<ξ<180° or a range of 270°<ξ360°.

If the slots 21*a* to 21*d* were provided at positions satisfying ξ=0°, 90°, 180°, or 270°, symmetry of the radiation conductor plate 12 would not be broken, and the effect of generating a circularly polarized wave would not be obtained. Therefore, the slots 21*a* to 21*d* must be provided in positions other than ξ=0°, 90°, 180°, or 270°. Note that a preferable set of values of ξ is 45°, 135°, 225°, and 315°.

Moreover, if all of the slots 21*a* to 21*d* were provided only in the two opposing ranges satisfying 0°<ξ<90° or 180°<ξ<270°, the rotation directions would be identical, so that no polarization switching effect would be obtained even if the polarization switching switches 23*a* to 23*d* were switched.

Therefore, in order to obtain a polarization switching function, it is necessary that at least one of the slots 21*a* to 21*d* is provided so as to satisfy either a range of 0°<ξ<90° or a range of 180°<ξ<270°, and that at least another is provided so as to satisfy either a range of 90°<ξ<180° or a range of 270°<ξ360°. As will be appreciated, FIG. 1 illustrates an example where one slot 21 is provided satisfying a range of 0°<ξ<90°; one slot 21 is provided satisfying a range of 90°<ξ<180°; one slot 21 is provided satisfying a range of 180°<ξ<270°; and one slot 21 is provided satisfying a range of 270°<ξ<360°.

Furthermore, if the radiation conductor plate 12 were not axisymmetrical with respect to the line extending through the center of gravity 24 of the radiation conductor plate 12 and through the feed point 13, symmetry of the radiation conductor plate would already be broken, without even providing the polarization switching elements. In this case, a circularly polarized wave (elliptically polarized wave) would already exist in either rotation direction, thus making it difficult to switch the rotation direction by providing the polarization switching elements. Therefore, it is necessary that the radiation conductor plate 12 is axisymmetrical with respect to the line extending through the center of gravity 24 of the radiation conductor plate 12 and through the feed point 13.

Each polarization switching switch (23*a* to 23*d*) is connected so as to bridge across the slot (21*a* to 21*d*), between an internal conductor 19 which is surrounded by the slot (21*a* to 21*d*) and the ground conductor plate 14 surrounding the slot (21*a* to 21*d*). By controlling at least one of the polarization switching switches 23*a* to 23*d* to conduct, a circularly polarized wave can be generated. By selecting the positions of the polarization switching switches 23*a* to 23*d* to conduct, switching of the rotation direction of a circularly polarized wave can be realized. Table 1 shows, when the polarization switching switches 23*a* to 23*d* in the antenna of FIG. 1 are switched, rotation directions of the circularly polarized wave that are obtained in the respective operating states according to Embodiment 1.

TABLE 1

| | polarization switching switch | | | | rotation direction of circularly |
|---|---|---|---|---|---|
| | 23a | 23b | 23c | 23d | polarized wave |
| 1 | conducting | open | open | open | clockwise |
| 2 | open | conducting | open | open | counterclockwise |
| 3 | open | open | conducting | open | clockwise |
| 4 | open | open | open | conducting | counterclockwise |

As shown in Table 1, by allowing a selected one of the polarization switching switches 23*a* to 23*d* to conduct, the rotation direction of the circularly polarized wave can be switched. Similarly, among the polarization switching switches 23*a* to 23*d*, either pair of diagonal switches (23*a* and 23*c*, or 23*b* and 23*d*) may be selectively allowed to conduct, whereby the rotation direction of the circularly polarized wave can be switched. Furthermore, three of the polarization switching switches 23*a* to 23*d* may be selectively allowed to conduct, whereby the rotation direction of the circularly polarized wave can be switched.

Note that, when only two adjoining switches (e.g. 23*a* and 23*b*) are allowed to conduct, and when all of the polarization switching switches are allowed to conduct or left open, a linearly polarized wave can be obtained from the antenna.

Circularly Polarized Wave Excitation Condition Q0(Δs/s) (FIG. 4)

In the antenna of Embodiment 1, a circularly polarized wave is generated by the slots 21*a* to 21*d* provided within the ground conductor plate 14 on the second substrate surface. Assuming a perturbation quantity Δ s/s which is determined by two parameters, i.e., an area s of the radiation conductor plate 12 and an area Δs of the overlapping portion (the hatched portion in FIG. 3) between the radiation conductor plate 12 and the region surrounded by each slot (21*a* to 21*d*), and assuming Q0 as an unloaded Q of the radiation conductor plate 12, the circularly-polarized-wave axial ratio of the radiation conductor plate 12 depends on a "circular polarization index" which is defined by Q0 (Δs/s), i.e., a product of the perturbation quantity and the unloaded Q.

Q0 is a value which is determined by the thickness, dielectric constant, and the like of the dielectric substrate 11. By disposing the slots 21*a* to 21*d* so that an optimum value of Δs is obtained for a given Q0, a circular polarization antenna having a good axial ratio can be realized.

FIG. 4 shows a circular-polarization-index dependence of the circularly-polarized-wave axial ratio with respect to the antenna of Embodiment 1, where the Q0 of the radiation conductor plate 12 is varied. In FIG. 4, the horizontal axis represents the circular polarization index value, whereas the vertical axis represents the circularly-polarized-wave axial ratio of the antenna of Embodiment 1. Herein, the dielectric substrate 11 has a constant dielectric constant of 2.08, while the thickness of the dielectric substrate 11 is varied so that Q0 of the radiation conductor plate is varied among 29.8, 22.8, and 18.3. As can be seen from FIG. 4, with the antenna of Embodiment 1, an axial ratio of 3 dB or less can be achieved under any of these three conditions by designing the antenna so that the circular polarization index is in a range of no less than 0.8 and no more than 1.6. By designing the antenna so that the circular polarization index is in a range of no less than 1.1 and no more than 1.3, the axial ratio is reduced to 1 dB or less, whereby a circularly polarized wave with even better axial ratio characteristics can be obtained.

Note that, even if Δs differs among the slots 21*a* to 21*d*, there is no problem in use so long as each Δs value satisfies the aforementioned range.

(Switching of a Maximum Gain Direction of Radiation Directivity)

Next, the principle behind switching of the maximum gain direction in accordance with the antenna of Embodiment 1 will be described. Switching of the maximum gain direction is performed with directivity switching elements. The directivity switching elements are composed of loop-shaped slots 21*a* to 21*d* and directivity switching switches 22*a* to 22*d*.

Each of the loop-shaped slots 21*a* to 21*d* resonates at a frequency which is substantially equal to the resonant frequency of the radiation conductor plate 12, and the peripheral length of each slot corresponds to one effective wavelength. At this time, the slots 21*a* to 21*d* function as antenna elements to which no power is fed (hereinafter "unfed elements"). Generally, an unfed element is known to act as a director when the resonant frequency of the unfed element is higher than the resonant frequency of an antenna element to which power is fed (hereinafter "fed element"), so that the directivity gain of the entire antenna is inclined in the direction in which the unfed element exists. On the other hand, when the resonant frequency of the unfed element is lower than the resonant frequency of the fed element, the unfed element is known to act as a reflector, so that the directivity gain of the entire antenna is inclined in the opposite direction to the direction in which the unfed element exists. In Embodiment 1, the slots 21*a* to 21*d*, which are unfed elements, are disposed around the radiation conductor plate 12, which is a fed element. Thus, the maximum gain direction of the antenna is allowed to be changed.

At least two directivity switching switches (22*a* to 22*d*) are provided for each slot, each directivity switching switch being connected so as to bridge across the slot (21*a* to 21*d*), between an internal conductor 19 which is surrounded by the slot (21*a* to 21*d*) and the ground conductor plate 14 surrounding the slot (21*a* to 21*d*). When each directivity switching switch (22*a* to 22*d*) is open, the slot (21*a* to 21*d*) functions as a director or a reflector as described above. On the other hand, when the directivity switching switch (22*a* to 22*d*) is allowed to conduct, the slot (21*a* to 21*d*) is split into two or more slots, whereby the aforementioned director or reflector function disappears. Therefore, by controlling the conducting/open states of the directivity switching switches 22*a* to 22*d*, a function of switching the maximum gain direction can be realized.

Note, however, that the directivity switching switches 22*a* to 22*d* must be positioned so that the slots 21*a* to 21*d* do not resonate when the directivity switching switches 22*a* to 22*d* are conducting. If each slot that has been split at both ends (i.e., the directivity switching switches 22*a* to 22*d*) acted as a resonator when the directivity switching switches (22*a* to 22*d*) are allowed to conduct, such slot resonators would exhibit similar effects to those of the aforementioned director or reflector. In this case, the director or reflector effects would not be eliminated even when the slots 21*a* to 21*d* are split by the conducting directivity switching switches (22*a* to 22*d*).

FIGS. 5A to 5C show exemplary unpreferable placements of directivity switching switches 22*a* to 22*d* of the antenna of Embodiment 1. As shown in FIGS. 5A to 5C, if the length of each slot that has been split at both ends (i.e., the directivity switching switches 22*a* to 22*d*) when the directivity switching switches (22*a* to 22*d*) are allowed to conduct were equal to half the effective wavelength, each slot that has been split at both ends (i.e., the directivity switching switches 22*a* to 22*d*) would act as a resonator with half the effective wavelength, and therefore the maximum gain direction would not be switched through control of the directivity switching switches 22*a* to 22*d*. Therefore, the directivity switching switches 22*a* to 22*d* must be positioned so that, when the directivity switching switches 22*a* to 22*d* are conducting, the length of each slot that has been split at both ends (i.e., the directivity switching switches 22*a* to 22*d*) is less than half the effective wavelength, or is greater than half the effective wavelength and yet less than one effective wavelength, thus to eliminate the unwanted resonation effect of each slot that has been split at both ends (i.e., the directivity switching switches 22*a* to 22*d*) when the directivity switching switches 22*a* to 22*d* are conducting.

Figure 6:
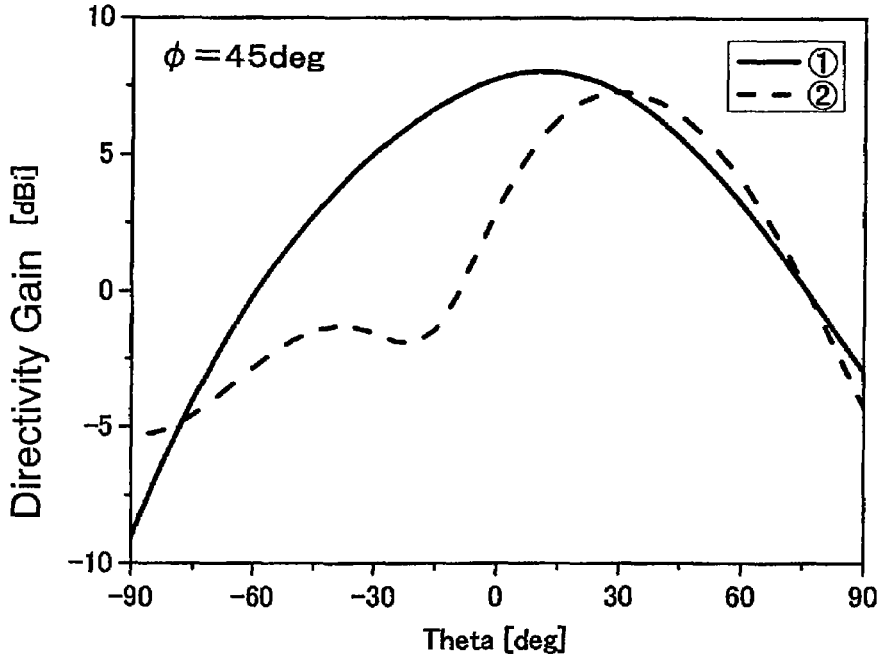
FIG. 6 is a graph showing changes in radiation directivity of a polarization switching/variable directivity antenna according to Embodiment 1 of the present invention.

Exemplary changes in radiation directivity of the antenna of Embodiment 1 obtained by switching the directivity switching switches 22*a* to 22*d* are shown in FIG. 6. FIG. 6 shows a θ dependence of directivity gain of the antenna on the φ=45° plane when the directivity switching switches 22*a* are controlled. In FIG. 6, (1) shows a state where the directivity switching switches 22*a* are conducting, whereas (2) shows a state where the directivity switching switches 22*a* are open. As shown in FIG. 6, in the case of (1), the maximum gain direction is substantially atop (θ=0°). In the case of (2), the slot 21*a* becomes a director, so that the maximum gain direction is shifted in the direction (θ=90° direction) in which the slot 21*a* exists, with an angle shift of about 30°. Thus, through control of the directivity switching switches 22*a* to 22*d*, the maximum gain direction can be switched.

Usually, on a radiation conductor plate 12 which is capable of transmitting or receiving circularly polarized waves, too, it is possible to change the maximum gain direction of the antenna regardless of the shape and size of the unfed element, so long as it resonates with the radiation conductor plate 12. However, it is difficult to obtain good axial ratio characteristics in the changed maximum gain direction. This is because the electromagnetic waves which are emitted from the unfed element deteriorate the axial ratio characteristics of the circularly polarized waves which are emitted from the radiation conductor plate 12.

According to Embodiment 1, such a deterioration in the axial ratio characteristics is avoided by employing as the unfed elements the loop-shaped slots 21*a* to 21*d* each of whose length is equal to one effective wavelength. In the case where a loop-shaped slot whose length is equal to one effective wavelength is used as an unfed element, at the same time as when a circularly polarized wave is excited on the radiation conductor plate 12, a circularly polarized wave having the same rotation direction is also excited on the loop-shaped slot. Thus, since circularly polarized waves having the same rotation direction are excited on both of the fed element and the unfed element, it becomes possible to switch the maximum gain direction while maintaining a good axial ratio. Moreover, when the rotation direction of the circularly polarized wave on the radiation conductor plate 12 is switched, the rotation direction of the circularly polarized wave which is excited on the loop-shaped slot (21*a* to 21*d*) is also switched simultaneously. Thus, since the rotation directions associated with the fed element and the unfed element are simultaneously switched, switching of the rotation direction of a circularly polarized wave becomes possible while maintaining a good axial ratio characteristics in the maximum gain direction.

In Embodiment 1, the slots composing the polarization switching elements also double as slots composing the directivity switching elements. By possessing both of a polarization switching switch (23*a* to 23*d*) and directivity switching switches (22*a* to 22*d*), each polarization switching element serves the functions of both a polarization switching element and a directivity switching element. As a result, despite its simple construction, an antenna is realized which is able to simultaneously perform switching of the maximum gain direction into multiple directions and switching of the rotation direction of a circularly polarized wave.

(Others)

Hereinafter, other constituent elements will be briefly described. As the dielectric substrate 11 according to Embodiment 1, any substrate that is commonly employed in high-frequency circuits can be used. For example, an inorganic material such as alumina ceramic, or a resin-type material such as Teflon (registered trademark), epoxy, or polyimide can be used. Any such material may be appropriately selected depending on the frequency used, the purpose, the thickness and size of the substrate, and so on. The radiation conductor plate 12 and the ground conductor plate 14 are patterns of a metal of good electrical conductivity, and copper, aluminum, or the like may be used therefor.

The Q0 of the radiation conductor plate 12 is usually set in a range of about 10 to about 30, since the radiation efficiency of the radiation conductor plate 12 will be in inverse proportion with Q0. When the above material is selected, Q0 can be set in the aforementioned range by appropriately selecting the thickness of the dielectric substrate 11.

Although the feed circuit in Embodiment 1 adopts coaxial feeding, any usual method for feeding power to the radiation conductor plate may be adopted, e.g., microstrip feeding or slot feeding.

As the directivity switching switches 22*a* to 22*d* and the polarization switching switches 23*a* to 23*d* in Embodiment 1, PIN diodes, FETs (Field Effect Transistors), MEMS (Micro Electro-Mechanical System) switches, or the like may be used, which are usually used in high-frequency regions.

Figure 7A:
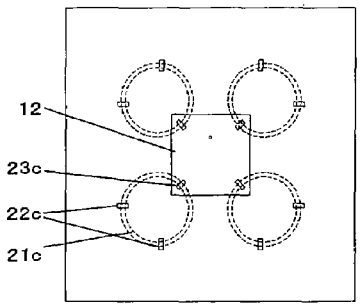
FIGS. 7A to 7C are diagrams illustrating other examples of polarization switching/variable directivity antennas according to Embodiment 1 of the present invention.
Figure 7B:
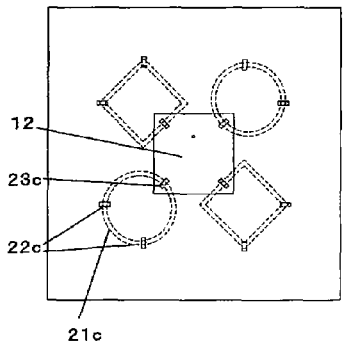
Figure 7C:
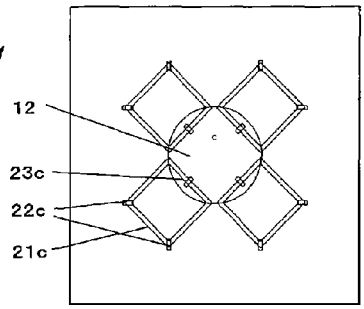

Note that, although Embodiment 1 employs a square conductor plate as the radiation conductor plate 12 and square slots as the slots 21*a* to 21*d*, similar effects can also be obtained with a radiation conductor plate and slots of any other shape, as shown in FIGS. 7A to 7C.

Although the slots 21*a* to 21*d* are placed in four directions in Embodiment 1, it is possible to provide N slots when using a radiation conductor plate which is a regular n-polygon, whereby the maximum gain direction can be switched into N directions. Herein, N may be appropriately selected in accordance with the number of directions into which switching is required.

EXAMPLE 1

Hereinafter, Example 1 of the present invention will be described. The antenna of Example 1 has the construction shown in FIGS. 1A to 1C, and an enlarged view of the slot section is as shown in FIG. 3. The constituent elements of Example 1 are as shown in Table 2.

TABLE 2

| | |
|---|---|
| dielectric substrate 11 | dielectric constant: 2.08<br>size: 13.5 × 13.5 × 0.4 mm |
| radiation conductor plate 12 | square<br>length L of one side: 3.7 mm |
| slots 21a to 21d | square loop<br>length s1 of one side: 2.9 mm<br>slot width w1: 0.2 mm |

TABLE 2-continued

| | |
|---|---|
| overlap Δs | length d of one side: 1.10 mm<br>area of Δs: 0.605 $mm^2$ |

Herein, the radiation conductor plate is sized so as to resonate in the TM mode at 25.4 GHz. In this case, the Q0 of the radiation conductor plate 12 is calculated to be 22.8, with the circular polarization index being 1.00. In Example 1, the directivity switching elements are allowed to function as directors.

FIGS. 8A, 8B, 8C and 8D are diagrams showing examples of how the directivity switching switches 22*a* to 22*d* and the polarization switching switches 23*a* to 23*d* may be controlled in order to change the maximum gain direction. In FIGS. 8A to 8D, it is meant that black switches are in a conducting state, whereas white switches are in an open state. In other words, FIG. 8A shows an example where the directivity switching switches 22*a*, 22*c*, and 22*d* and the polarization switching switch 23*c* in FIG. 1 are conducting while all the other switches are open.

Figures 9A, 9B, 9C, 9D:
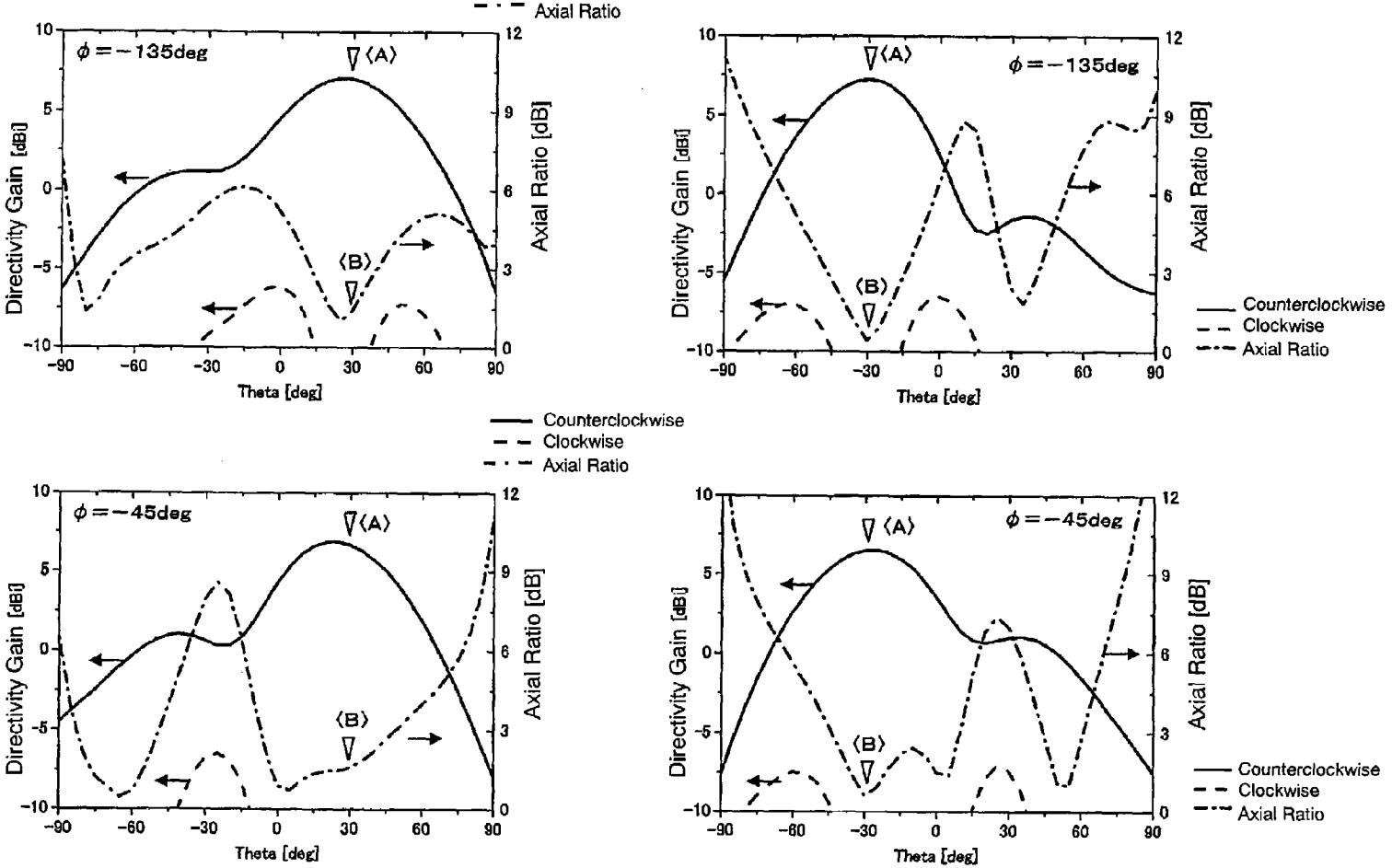
FIGS. 9A to 9D are graphs showing changes in radiation directivity of a polarization switching/variable directivity antenna according to Example 1 of the present invention.

FIGS. 9A to 9D show the radiation directivity of the antenna of Example 1, in the case where the directivity switching switches 22*a* to 22*d* and the polarization switching switches 23*a* to 23*d* are controlled as shown in FIGS. 8A to 8D, respectively. FIGS. 9A and 9B, which respectively correspond to FIGS. 8A and 8B, each show a θ dependence of directivity gain on the $\phi=-135°$ plane. FIGS. 9C and 9D, which respectively correspond to FIGS. 8C and 8D, each show a θ dependence of directivity gain on the $\phi=-45°$ plane.

As shown by <A> in FIGS. 9A and 9B, by controlling the directivity switching switches 22*a* to 22*d* and the polarization switching switches 23*a* to 23*d* as shown in FIGS. 8A and 8B, the maximum gain direction of a counterclockwise circular-polarization component obtained with the antenna was switched into the +30° direction (FIG. 9A) or the −30° direction (FIG. 9B) on the $\phi=-135°$ plane. Similarly, as shown by <A> in FIGS. 9C and 9D, by controlling the directivity switching switches 22*a* to 22*d* and the polarization switching switches 23*a* to 23*d* as shown in FIGS. 8C and 8D, the maximum gain direction was switched into the +30° direction (FIG. 9C) or the −30° direction (FIG. 9D) on the $\phi=-45°$ plane. At this time, as shown by <B> in FIGS. 9A to 9D, an axial ratio of 3 dB or less was achieved in the maximum gain direction under all of these conditions.

Figure 10B:
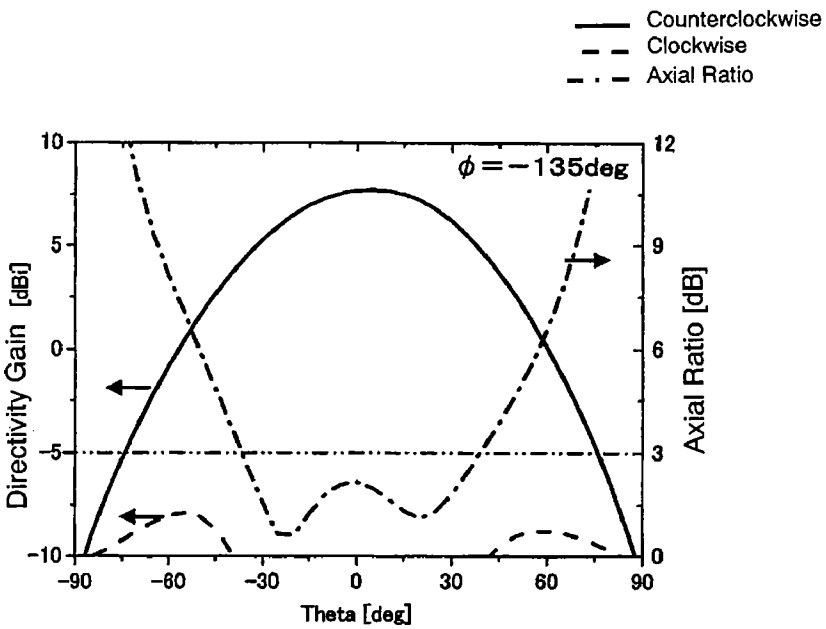
FIGS. 10A and 10B are a diagram showing an example of how switches of a polarization switching/variable directivity antenna according to Embodiment 1 of the present invention may be controlled, and a graph showing changes in radiation directivity thereof, respectively.
Figure 10A:
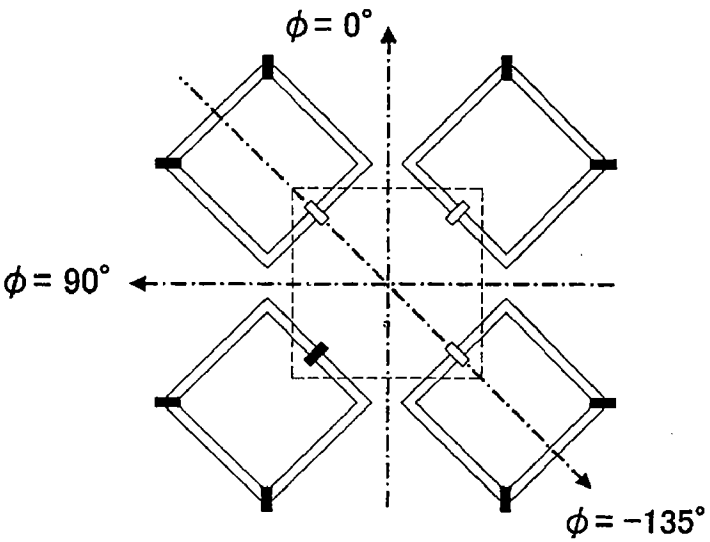

Moreover, FIG. 10A shows the states of the switches when all of the directivity switching switches 22*a* to 22*d* are conducting, and FIG. 10B shows a θ dependence of directivity gain of the antenna on the $\phi=-135°$ plane in the state of FIG. 10A. As shown in FIG. 10B, when all of the directivity switching switches 22*a* to 22*d* were conducting, the maximum gain direction of the antenna was 0°. At this time, an axial ratio of 3 dB or less was achieved at $\phi=0°$.

Figure 11B:
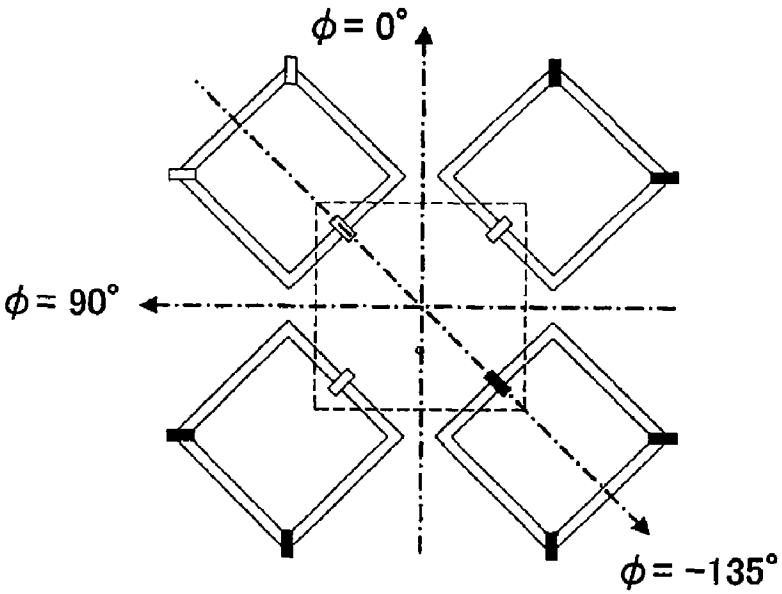
FIGS. 11A and 11B are diagrams showing examples of how switches of a polarization switching/variable directivity antenna according to Example 1 of the present invention may be controlled.
Figure 11A:
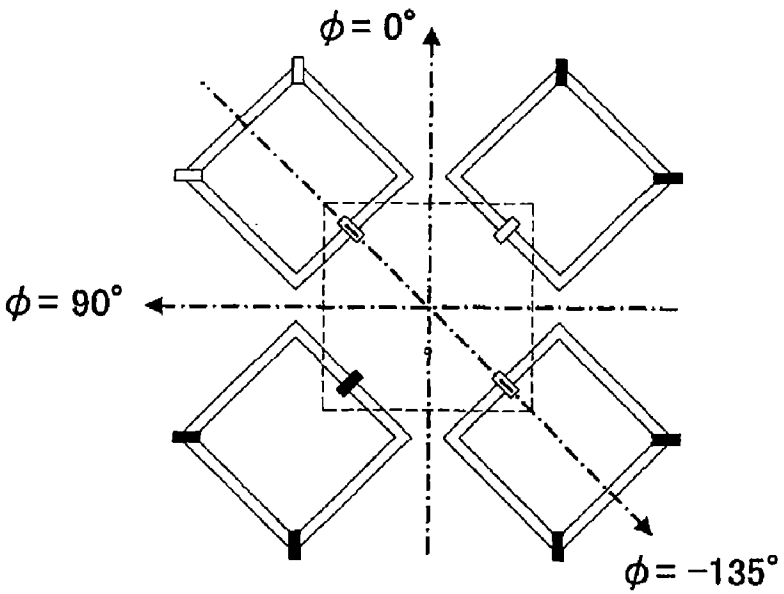
Figure 12B:
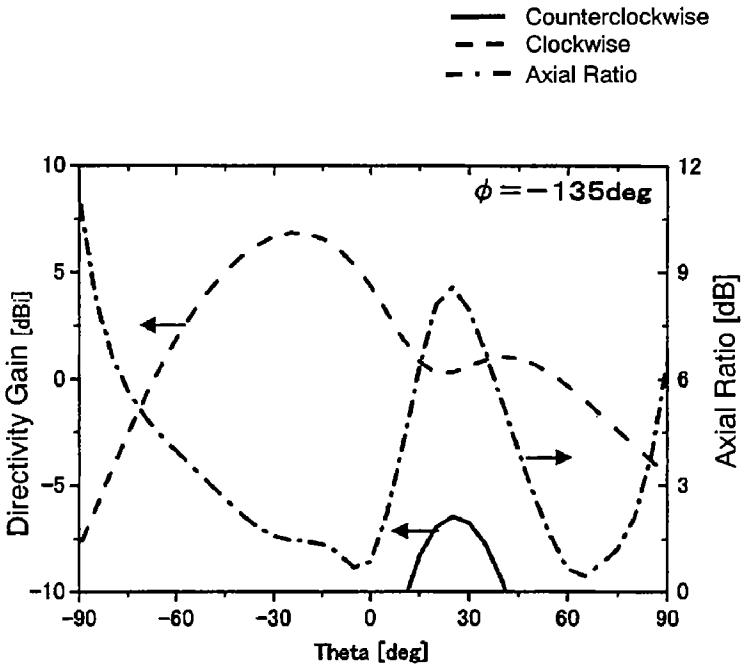
FIGS. 12A and 12B are graphs showing switching of the radiation directivity and the rotation direction of a circularly polarized wave of a polarization switching/variable directivity antenna according to Example 1 of the present invention.
Figure 12A:
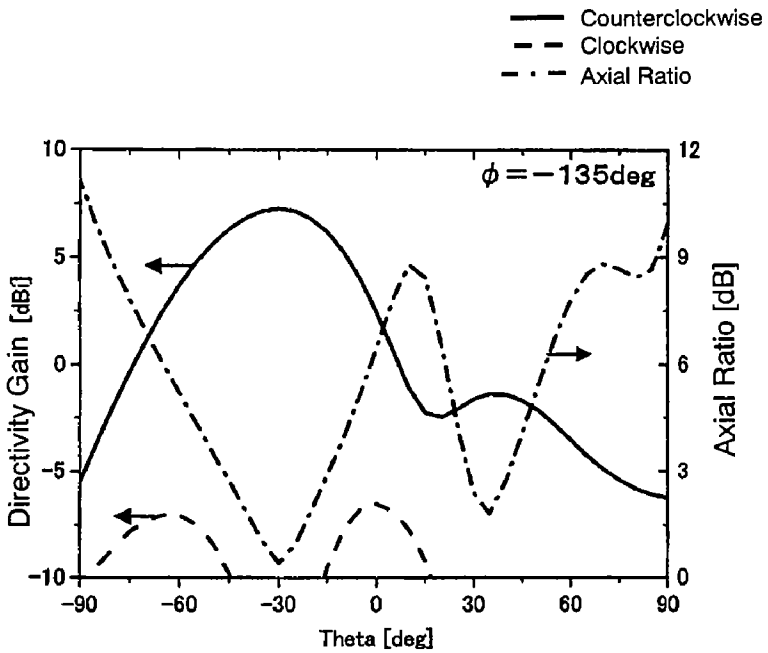

FIGS. 11A and 11B show examples of how the polarization switching switches 23*a* to 23*d* may be controlled. FIGS. 12A and 12B show the θ dependences of directivity gain of the antennas shown in FIGS. 11A and 11B, respectively, on the $\phi=-135°$ plane. As shown in FIGS. 12A and 12B, by switching the polarization switching switches 23*a* to 23*d*, the rotation direction of a circularly polarized wave was switched from counterclockwise to clockwise.

Table 3 summarizes the rotation directions of a circularly polarized wave and the maximum gain directions obtained by switching the directivity switching switches 22*a* to 22*d* and the polarization switching switches 23*a* to 23*d* according to Example 1.

TABLE 3

| | directivity switching switch | | | | polarization switching switch | | | | rotation direction of circularly | maximum gain direction | |
|---|---|---|---|---|---|---|---|---|---|---|---|
| | 22a | 22b | 22c | 22d | 23a | 23b | 23c | 23d | polarized wave | ϕ [°] | θ [°] |
| 1 | con. | open | con. | con. | open | open | con. | open | counter | −135 | 30 |
| 2 | con. | con. | con. | open | open | open | con. | open | counter | −135 | −30 |
| 3 | open | con. | con. | con. | open | open | con. | open | counter | −45 | 30 |
| 4 | con. | con. | open | con. | con. | open | open | open | counter | −45 | −30 |
| 5 | con. | con. | con. | con. | open | open | con. | open | counter | 0 | 0 |
| 6 | con. | open | con. | con. | open | open | open | con. | clockwise | −135 | 30 |
| 7 | con. | con. | con. | open | open | con. | open | open | clockwise | −135 | −30 |
| 8 | open | con. | con. | con. | open | con. | open | open | clockwise | −45 | 30 |
| 9 | con. | con. | open | con. | open | con. | open | open | clockwise | −45 | −30 |
| 10 | con. | con. | con. | con. | open | con. | open | open | clockwise | 0 | 0 |

con. = conducting
counter = counterclockwise

As shown in Table 3, by controlling the directivity switching switches 22*a* to 22*d* and the polarization switching switches 23*a* to 23*d,* switching of the rotation direction of a circularly polarized wave and switching of the maximum gain direction into multiple directions are simultaneously possible.

Thus, based on the above-described construction, there is realized an antenna which is capable of switching the maximum gain direction into multiple directions, and at the same time switching the rotation direction of a circularly polarized wave in the maximum gain direction.

Embodiment 2

Figure 13:
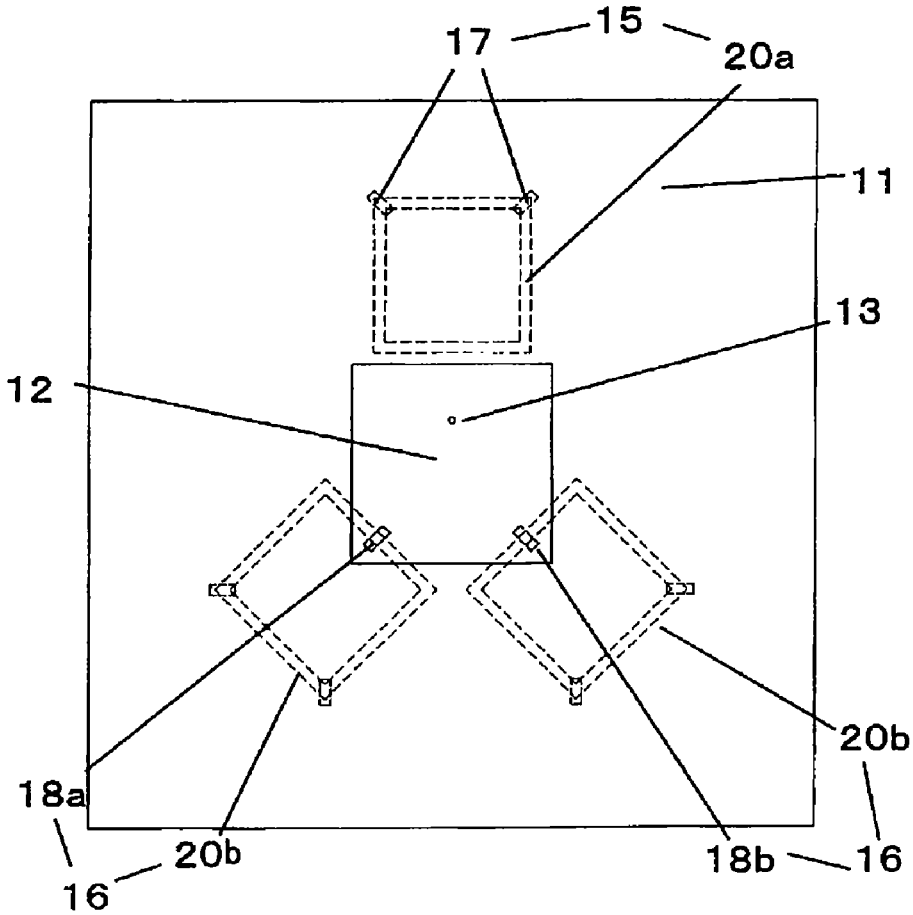
FIG. 13 is a schematic illustration of a polarization switching/variable directivity antenna according to Embodiment 2 of the present invention.

Next, with reference to the drawings, a polarization switching/variable directivity antenna according to Embodiment 2 of the present invention will be described. FIG. 13 is a see-through view of a first substrate surface according to Embodiment 2 of the present invention. Portions which are drawn by broken lines are meant to be formed on a second substrate surface. The detailed description of any portion that has an identical counterpart in Embodiment 1 will be omitted.

In Embodiment 1, each polarization switching element 16 has both of a polarization switching function and a directivity switching function. In Embodiment 2, however, polarization switching elements and a directivity switching element are independently provided.

In Embodiment 2, each polarization switching element 16 is composed of a loop-shaped slot 20*b* and polarization switching switches 18*a* and 18*b*. The conditions which must be satisfied by the polarization switching elements 16 are the same as those described in Embodiment 1. Similarly to Embodiment 1, by controlling the polarization switching switches 18*a* and 18*b,* the rotation direction of a circularly polarized wave can be switched.

In Embodiment 2, a directivity switching element 15 is composed of a loop-shaped slot 20*a* and directivity switching switches 17. The conditions to be satisfied by the directivity switching element 15 are the same as those described in Embodiment 1. Similarly to Embodiment 1, by controlling the directivity switching switches 17, the maximum gain direction can be switched into the direction in which the directivity switching element 15 exists.

In the antenna of Embodiment 2, the directivity switching element and the polarization switching elements are independently provided. As a result, with an even simpler construction than that of Embodiment 1, switching of the polarization rotation direction and switching of the maximum gain direction along one axis can be realized.

Figure 14B:
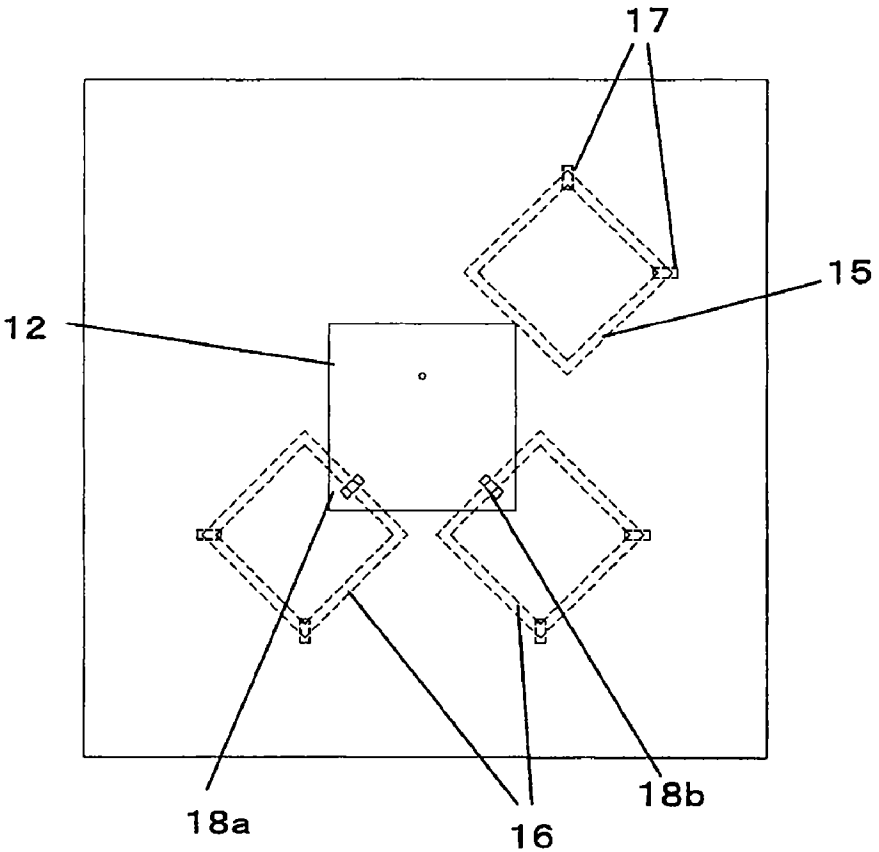
FIGS. 14A and 14B are other examples of polarization switching/variable directivity antennas according to Embodiment 2 of the present invention.
Figure 14A:
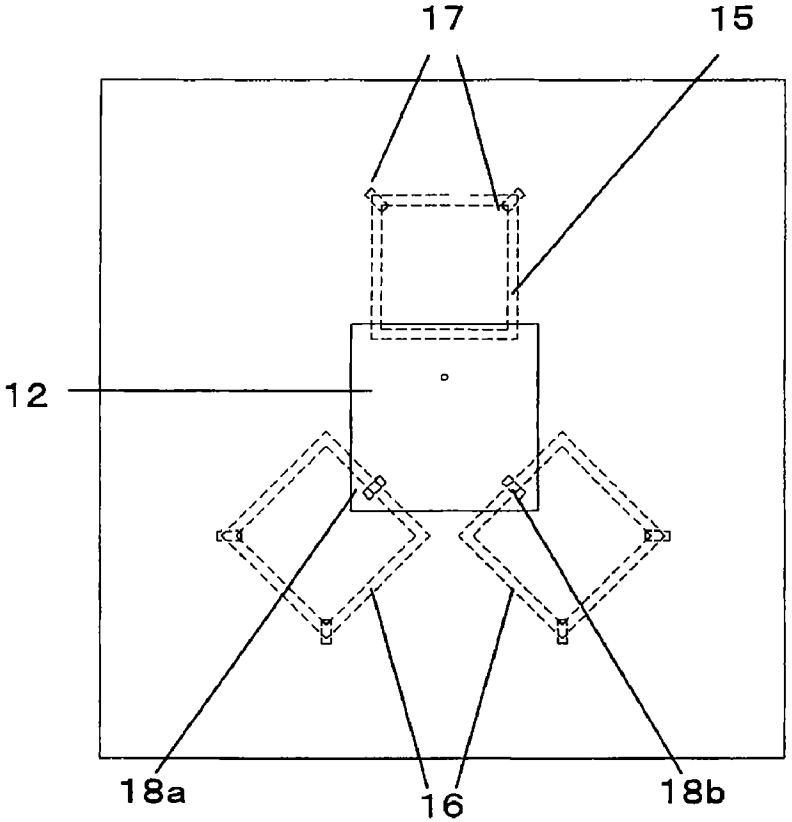

Note that, even when the position of the directivity switching element 15 is changed as shown in FIGS. 14A and 14B, similar effects of Embodiment 2 are obtained. Moreover, as in Embodiment 1, a slot of any shape other than a square may be employed for the directivity switching element 15 and each polarization switching element 16.

Although Embodiment 2 illustrates switching of the maximum gain direction along one axis, the number of directivity switching elements may be increased to N according to the number of directions to be switched, whereby switching into N maximum gain directions becomes possible.

EXAMPLE 2

Figure 15:
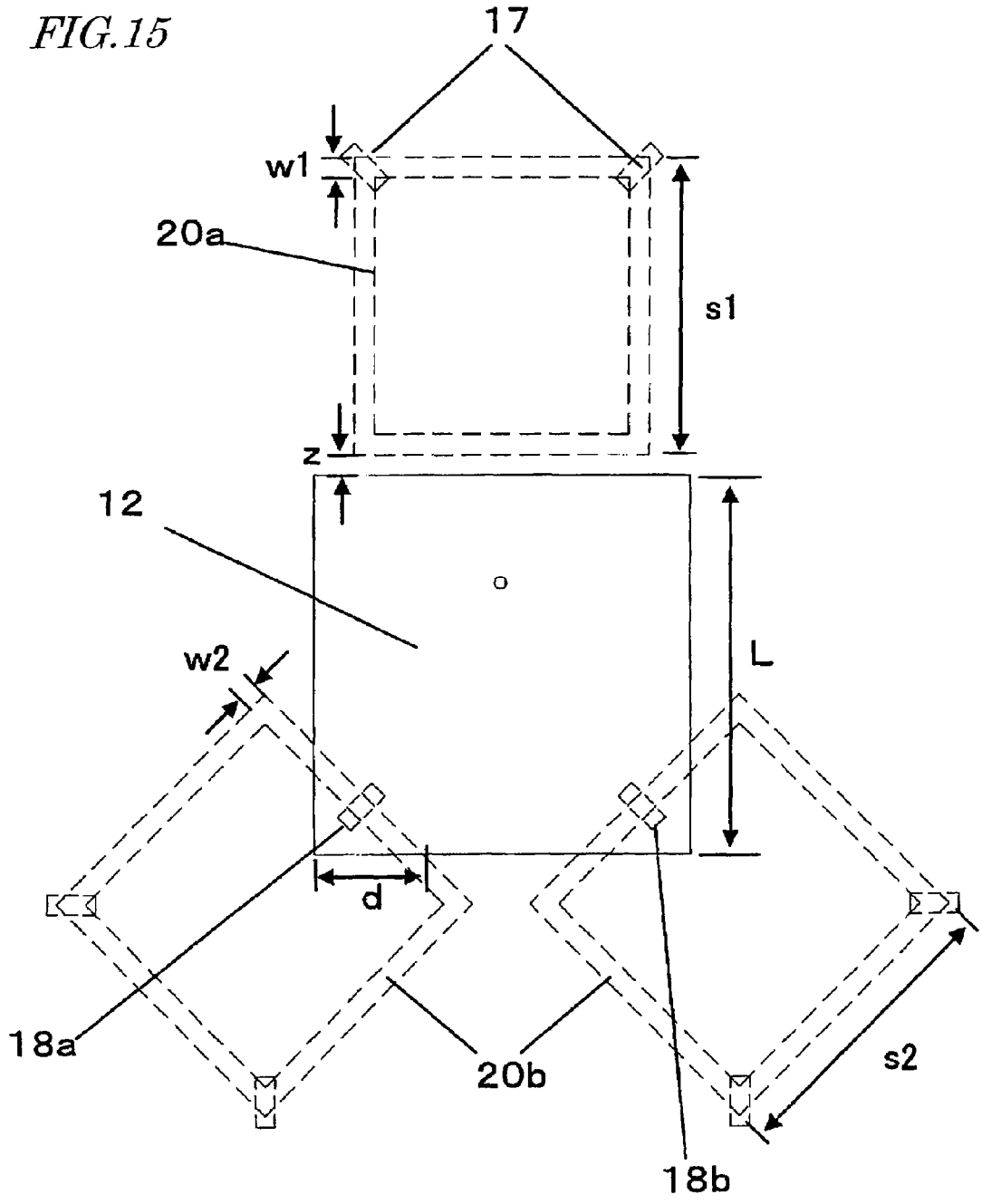
FIG. 15 is an enlarged view of a polarization switching/variable directivity antenna according to Example 2 of the present invention.

Hereinafter, Example 2 of the present invention will be described. FIG. 13 shows a see-through view of a first substrate surface of an antenna of Example 2. FIG. 15 shows an enlarged view of the radiation conductor plate 12 and the slots 20*a* and 20*b*. The dielectric substrate 11 and the radiation conductor plate 12 are similar to those of Example 1. One side of the slot 20*a* has a length s1 of 2.9 mm, and the slot 20*a* has a width w1 of 0.2 mm and a distance z of 0.2 mm from the radiation conductor plate 12. One side of each slot 20*b* has a length s2 of 2.9 mm, and each slot 20*b* has a width w2 of 0.2 mm. One side of the overlapping area Δs has a length d of 1.15 mm. In this case, the circular polarization index is 1.10. Moreover, as in Example 1, the directivity switching element is allowed to function as a director.

Figure 16A:
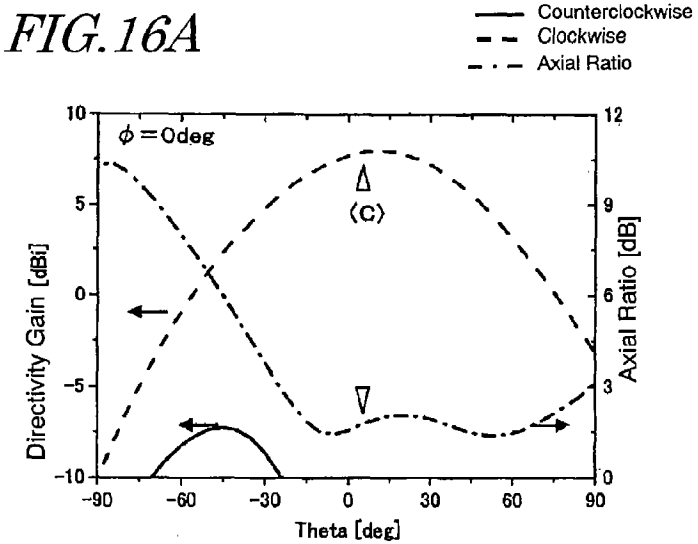
FIGS. 16A to 16C are graphs showing changes in radiation directivity and polarization components of a polarization switching/variable directivity antenna according to Example 2 of the present invention.
Figure 16B:
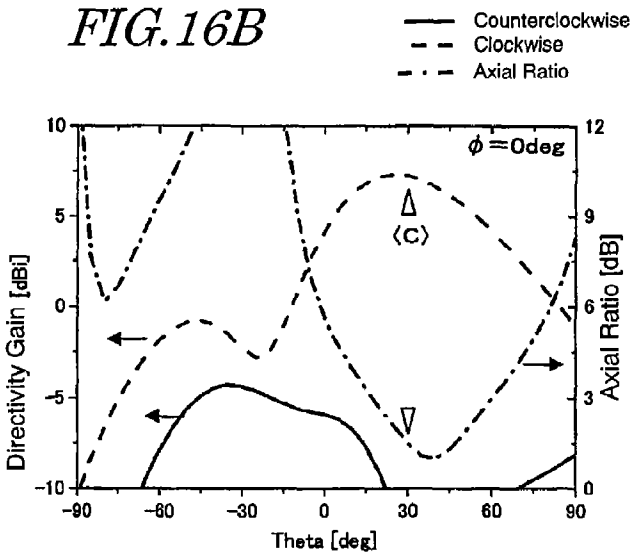
Figure 16C:
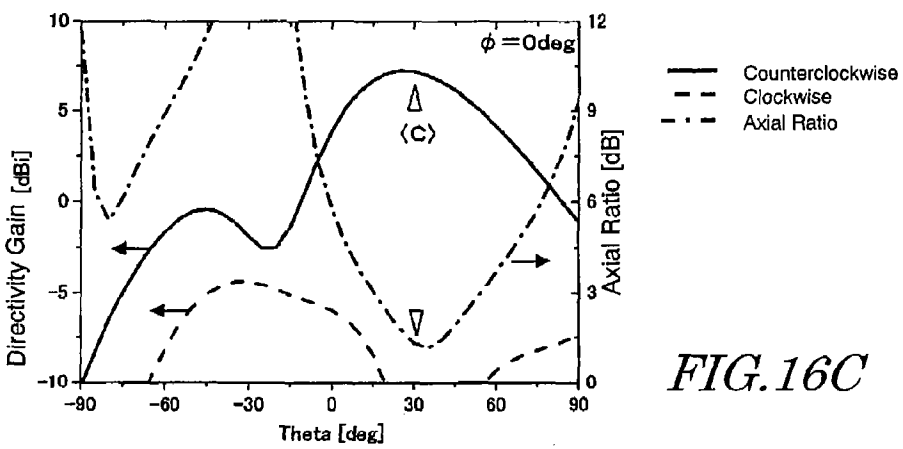
Figure 17A:
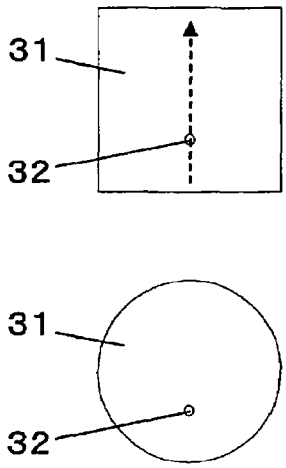
FIGS. 17A to 17C are diagrams showing structures of a generic linear antenna and generic circular polarization antennas.
Figure 17B:
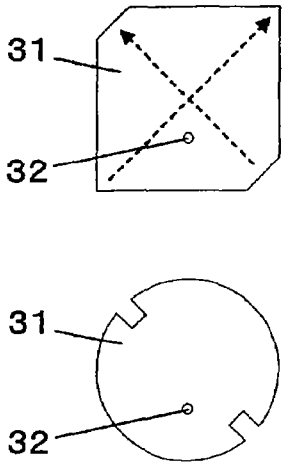
Figure 17C:
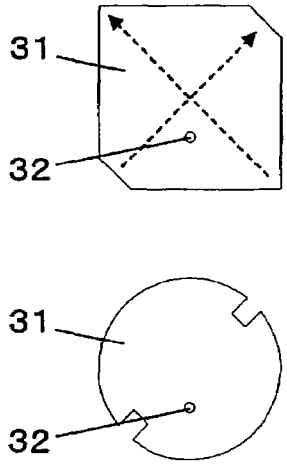
Figure 18B:
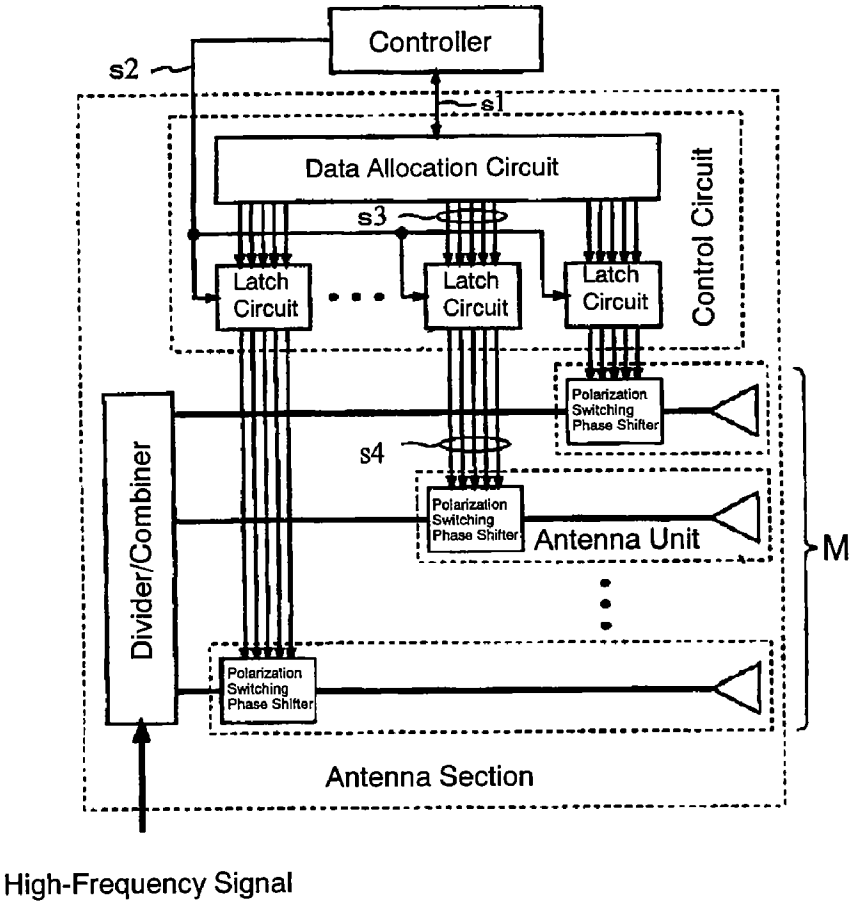
FIGS. 18A and 18B are schematic illustrations of a conventional circular polarization switching type-phased array antenna.
Figure 18A:
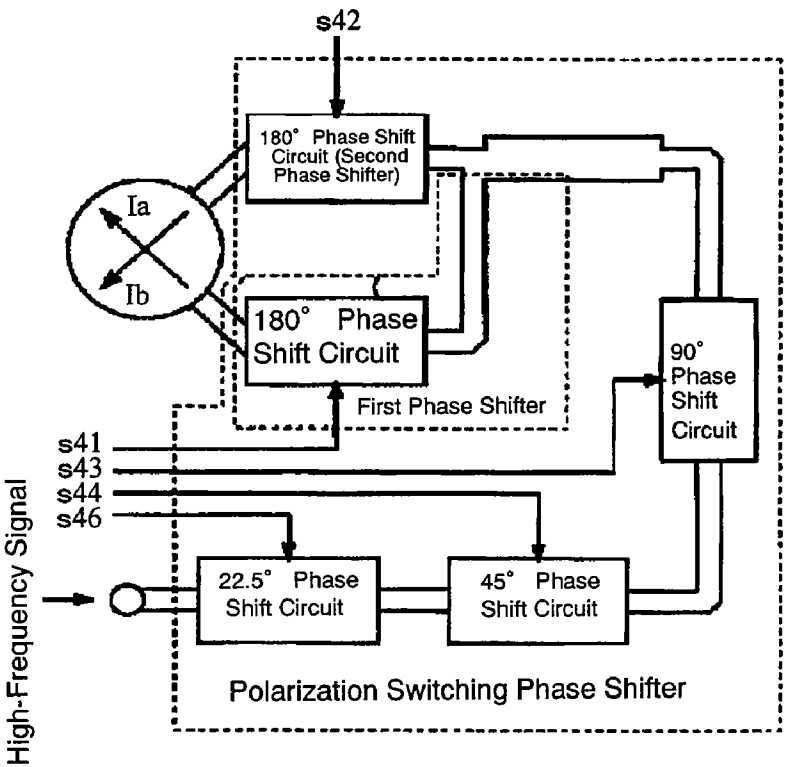

The radiation directivity of the antenna of Example 2 is shown in FIGS. 16A to 16C. FIG. 16A shows a θ dependence of directivity gain on the ϕ=0° plane in the case where the directivity switching switches 17 are conducting whereas the polarization switching switches 18*a* and 18*b* are open and conducting, respectively, in FIG. 13. FIG. 16B shows a θ dependence of directivity gain on the ϕ=0° plane in the case where the directivity switching switches 17 are open whereas the polarization switching switches 18*a* and 18*b* are open and conducting, respectively. FIG. 16C shows a θ dependence of directivity gain on the ϕ=0° plane in the case where the directivity switching switches 17 are open whereas the polarization switching switches 18*a* and 18*b* are conducting and open, respectively.

As shown by <C> in FIGS. 16A and 16B, by switching the directivity switching switches 17, the maximum gain direction of the antenna was switched without changing the rotation direction (clockwise) of the circularly polarized wave.

Moreover, as shown by <C> in FIGS. 16B and 16C, by switching the polarization switching switches 18*a* and 18*b*, the rotation direction of the circularly polarized wave was switched while fixing the maximum gain direction.

Table 4 shows, when the directivity switching switches 17 and the polarization switching switches 18*a* and 18*b* are switched, the rotation directions of a circularly polarized wave and the maximum gain directions that are obtained in the respective operating states according to Example 2.

TABLE 4

| | directivity switching | polarization switching switch | | rotation direction of circularly | maximum gain |
|---|---|---|---|---|---|
| | switch 17 | 18a | 18b | polarized wave | direction |
| 1 | conducting | conducting | open | counterclockwise | θ = 0° direction |
| 2 | conducting | open | conducting | clockwise | θ = 0° direction |
| 3 | open | conducting | open | counterclockwise | +θ direction |
| 4 | open | open | conducting | clockwise | +θ direction |

Thus, by adopting the above-described construction, an antenna was realized which is capable of switching the maximum gain direction along one axis through control of the directivity switching switches 17, and switching the rotation direction of a circularly polarized wave through control of the polarization switching switches 18*a* and 18*b*.

Despite its simple construction, a polarization switching/variable directivity antenna according to the present invention is characterized by being able to simultaneously realize switching of the rotation direction of a circularly polarized wave and switching of the maximum gain direction of radiation directivity, and therefore is useful as an antenna for use in an indoor mobile terminal device or the like. Moreover, the antenna is useful as an on-vehicle antenna for ETC or a small receiving antenna for satellite broadcast, which currently performs transmission/reception by using circularly polarized waves. Furthermore, the antenna is useful as an antenna used for wireless power transmission.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A polarization switching/variable directivity antenna comprising:

a dielectric substrate having two opposing surfaces;

a radiation conductor plate formed on one of the surfaces of the dielectric substrate;

a feed point provided on the radiation conductor plate;

a ground conductor plate formed on the other surface of the dielectric substrate;

at least one directivity switching element provided on the ground conductor plate side of the dielectric substrate; and at least two polarization switching elements provided on the ground conductor plate side of the dielectric substrate, wherein, the radiation conductor plate is shaped so as to be axisymmetrical with respect to a line extending through a center of gravity of the radiation conductor plate and through the feed point, the feed point being a point where feeding means is in contact with the radiation conductor plate;

the at least one directivity switching element includes a first slot which is formed by removing a loop-like portion from the ground conductor plate, and at least two directivity switching switches which are connected so as to bridge between an internal conductor surrounded by the first slot and the ground conductor plate surrounding the first slot;

the first slot resonates at a frequency which is substantially equal to a resonant frequency of the radiation conductor plate;

the peripheral length of the first slot corresponds to one effective wavelength at an operating frequency;

the directivity switching switches are positioned so that, when the first slot is split into a plurality of slots in high-frequency terms by allowing all of the at least two directivity switching switches to conduct, the length of each slot having been split at both ends which are the at least two directivity switching switches is less than half the effective wavelength, or is greater than half the effective wavelength and yet less than one effective wavelength;

the at least two polarization switching elements each include a second slot which is formed by removing a loop-like portion from the ground conductor plate, and at least one polarization switching switch which is connected so as to bridge between an internal conductor surrounded by the second slot and the ground conductor plate surrounding the second slot;

a portion of the second slot is in a position overlapping the radiation conductor plate;

the circular polarization index Q0(Δs/s) has a value of no less than 0.8 and no more than 1.6, where Δs is an area of an overlap between the radiation conductor plate and a region surrounded by each second slot; s is an area of the radiation conductor plate; and Q0 is an unloaded Q of the radiation conductor plate; and with respect to an angle ξ between a line extending through the center of gravity of the radiation conductor plate and through the feed point and a line extending through the center of gravity of the radiation conductor plate and through a center of gravity of the second slot, one second slot of the at least two polarization switching elements is provided so as to satisfy either a range of 0°<ξ<90° or a range of 180°<ξ21 270°; and another second slot of the at least two polarization switching elements is provided so as to satisfy either a range of 90°<ξ<180° or a range of 270°<ξ360°.

2. The polarization switching/variable directivity antenna of claim 1, wherein the circular polarization index is no less than 1.1 and no more than 1.3.

3. The polarization switching/variable directivity antenna of claim 1, wherein each second slot (20*b*, 20*c*) comprised by the at least two polarization switching elements is also a first slot comprised by the at least one directivity switching element, such that both of the at least one polarization switching switch and the at least two directivity switching switches are provided on the second slot (20*b*, 20*c*), whereby each polarization switching element serves both a polarization switching function and a directivity switching function.

* * * * *

UNITED STATES PATENT AND TRADEMARK OFFICE

CERTIFICATE OF CORRECTION

PATENT NO. : 7,391,377 B2
APPLICATION NO. : 11/938497
DATED : June 24, 2008
INVENTOR(S) : Akio Matsushita et al.

It is certified that error appears in the above-identified patent and that said Letters Patent is hereby corrected as shown below:

On the title page, below the data for Item "(63)", insert
--(30) Foreign Application Priority Data
April 14, 2006 (JP).....2006-111756--; and In Column 16, Line 50 (Claim 1), change "180° < ξ21 270°" to --180° < ξ < 270°--.

Signed and Sealed this

Seventeenth Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,391,377 B2
APPLICATION NO. : 11/938497
DATED : June 24, 2008
INVENTOR(S) : Akio Matsushita et al.

It is certified that error appears in the above-identified patent and that said Letters Patent is hereby corrected as shown below:

In Column 16, Line 53 (Claim 1), change "270°<ξ360°" to --270° < ξ < 360°--.

Signed and Sealed this

Seventh Day of April, 2009

JOHN DOLL
*Acting Director of the United States Patent and Trademark Office*